US010676167B2

(12) United States Patent
Tiedge et al.

(10) Patent No.: US 10,676,167 B2
(45) Date of Patent: Jun. 9, 2020

(54) BOAT LIFT

(71) Applicant: LIPPERT COMPONENTS, INC., Elkhart, IN (US)

(72) Inventors: Robert L. Tiedge, Granger, IN (US); Mark Kinder, Clarks Hill, IN (US); Nicholas Cornett, Granger, IN (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 0 days.

(21) Appl. No.: 15/991,465

(22) Filed: May 29, 2018

(65) Prior Publication Data

US 2018/0339755 A1 Nov. 29, 2018

Related U.S. Application Data

(60) Provisional application No. 62/511,625, filed on May 26, 2017, provisional application No. 62/710,391, filed on Feb. 16, 2018.

(51) Int. Cl.

| | |
|---|---|
| ***B63C 1/02*** | (2006.01) |
| ***B63C 5/02*** | (2006.01) |
| ***B63C 3/12*** | (2006.01) |
| ***B63C 3/06*** | (2006.01) |

(52) U.S. Cl.

CPC ..... *B63C 1/02* (2013.01); *B63C 3/06* (2013.01); *B63C 3/12* (2013.01); *B63C 5/02* (2013.01)

(58) Field of Classification Search

CPC .... B63C 1/02; B63C 3/06; B63C 3/12; B63C 5/02; B63C 1/06

USPC ..... 114/44, 45, 48

See application file for complete search history.

(56) References Cited

U.S. PATENT DOCUMENTS

| | | | | |
|---|---|---|---|---|
| 4,195,948 | A | 4/1980 | Vancil | |
| 4,773,346 | A | 9/1988 | Blanding et al. | |
| 5,099,778 | A * | 3/1992 | Palen | B63C 3/06 114/45 |
| 5,655,850 | A | 8/1997 | Holmgren | |
| 5,735,216 | A | 4/1998 | Bullock et al. | |
| 6,536,992 | B1 | 3/2003 | Floe | |
| 6,554,533 | B2 * | 4/2003 | Godbersen | B63C 3/06 114/44 |
| 6,695,533 | B1 | 2/2004 | Bulmann | |
| 6,709,197 | B1 * | 3/2004 | Sargent | B63C 3/06 114/44 |
| 6,830,002 | B1 | 12/2004 | Walker | |
| 7,059,803 | B2 | 6/2006 | Floe et al. | |
| 7,219,770 | B2 * | 5/2007 | Baker | B66F 3/46 187/210 |
| 7,229,086 | B1 | 6/2007 | Rogers | |
| 7,273,329 | B2 | 9/2007 | Spratt et al. | |

(Continued)

*Primary Examiner* — Anthony D Wiest

(74) *Attorney, Agent, or Firm* — Nixon & Vanderhye P.C.

(57) ABSTRACT

A boat lift includes four posts and four linear actuators, each attached to one of the posts. Each linear actuator includes an extendable and retractable member oriented for extension and retraction substantially parallel to the post. Ends of a first pair of the extendable and retractable members are connected to a first carrier and ends of a second pair of the extendable and retractable members are connected to a second carrier. A cradle or platform is supported by the first and second carriers. The boat lift may be supported by the ground, by a structure, for example, a dock, a sea wall or a wall of a boat house, or by pontoons.

16 Claims, 9 Drawing Sheets

(56) References Cited

U.S. PATENT DOCUMENTS

| | | | | |
|---|---|---|---|---|
| 8,267,621 | B1 | 9/2012 | Way | |
| 8,282,053 | B2 | 10/2012 | Mensching | |
| 9,156,441 | B2 | 10/2015 | Tiedge | |
| 2007/0059099 | A1 | 3/2007 | Anderson | |
| 2010/0239371 | A1* | 9/2010 | Brown | E02C 5/00 405/3 |
| 2017/0043849 | A1* | 2/2017 | Brown | B63C 3/06 |

* cited by examiner

BOAT LIFT

CROSS-REFERENCE TO PRIOR APPLICATIONS

This application claims benefit under 35 U.S.C. § 119 of U.S. Provisional Patent Application Nos. 62/511,625, filed on May 26, 2017, and 62/710,391, filed on Feb. 16, 2018, and incorporates by reference the disclosures thereof in their entireties. Any discrepancy between this disclosure and the foregoing disclosures is to be resolved in favor of this disclosure.

BACKGROUND AND SUMMARY OF THE DISCLOSURE

A hull of a boat resting in a body of water tends to become plated with organic and other contaminants. Such plating can be unsightly, damaging to the boat, and serve to reduce the boat's operating efficiency.

In order to mitigate such plating, it is known to elevate boats, especially smaller pleasure craft, out of the water when not in use. Various forms of boat lift have been developed for this purpose. Such boat lifts typically include a base that rests on and/or is anchored to the bottom of the body of water, for example, to a lake bottom, an elevatable portion or cradle configured to support the hull of a boat, and a mechanism configured to raise and lower the cradle with respect to the base.

One such mechanism involves a cable and pulley arrangement wherein displacement of the cable in a first direction raises the cradle and displacement of the cable in a second direction lowers the cradle. The cable may be displaced in the first direction by winding it onto a spool, and the cable may be displaced in the second direction by unwinding it from the spool. The spool may be driven by a hand wheel operating through a gear box. This type of mechanism is relatively simple and inexpensive, but it can be require considerable time and effort to operate. Also, the cable and pulleys are susceptible to damage and wear through use and corrosion through contact with the environment, including the water in which the boat lift is installed.

Another such mechanism involves one or more hydraulic actuators, each having a cylinder and piston rod, connected between the base and the cradle and a hydraulic pump and controller for operating the actuator(s). This type of mechanism is relatively easy to operate, but typically is much more expensive than a cable and pulley-type of boat lift. Also, such mechanisms typically are configured with the actuator below the water line so that the actuator piston rod is extended from the actuator cylinder when the cradle is in the elevated position (where it typically spends the great majority of its time). As such, the piston rod is susceptible to corrosion and plating of contaminants thereon. Such corrosion and plating can damage the seal between the piston rod and cylinder and lead to leakage of hydraulic fluid out of the actuator. This can diminish the performance of the actuator and pollute the environment in which the boat lift is installed.

BRIEF DESCRIPTION OF THE DRAWINGS AND PHOTOGRAPHS

DETAILED DESCRIPTION OF THE DRAWINGS

References to orientation, for example, vertical and horizontal, left and right, up and down, front and back, and the like, should be construed in a relative, rather than absolute, sense unless context dictates otherwise.

General Description

Figure 1:
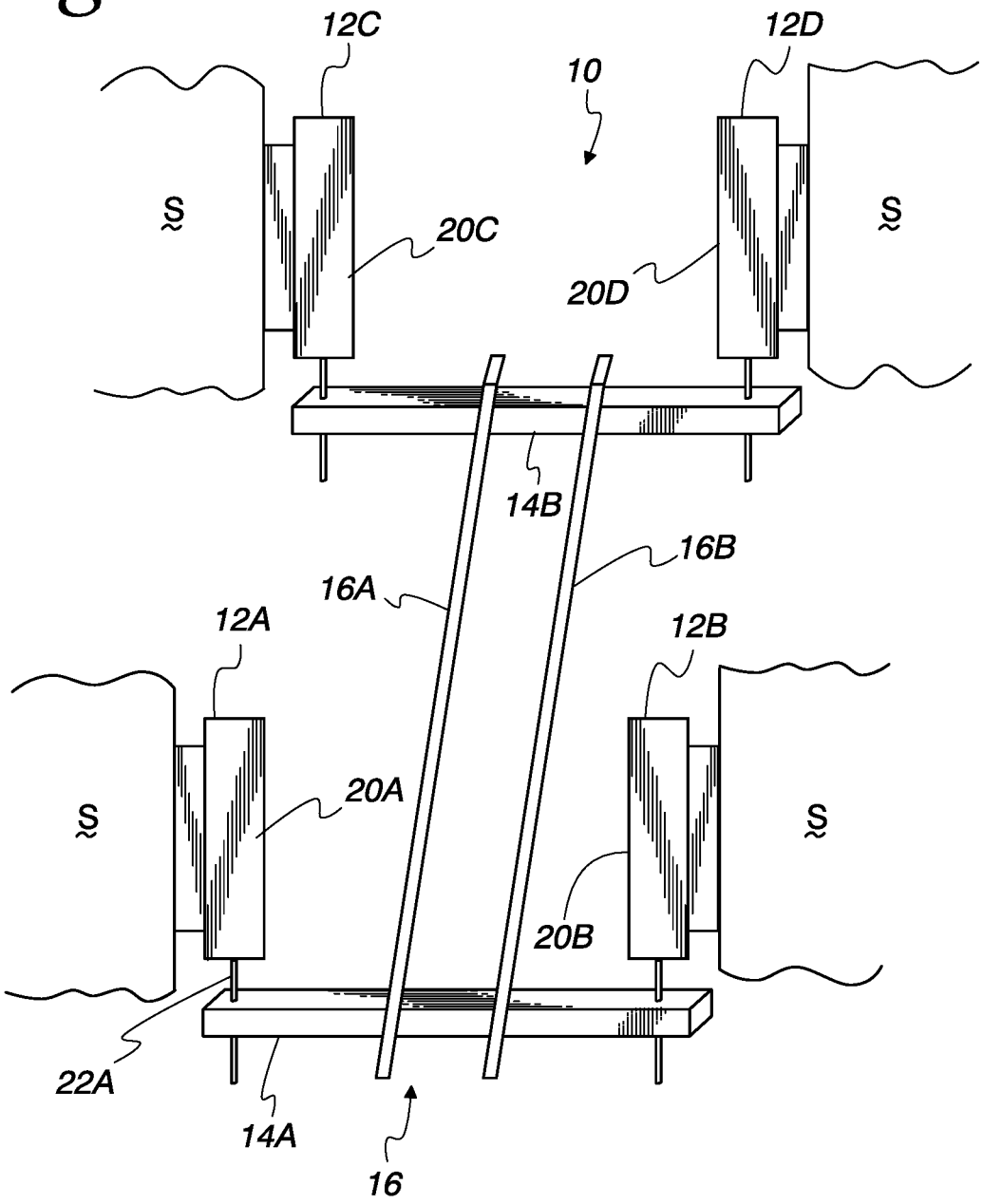
FIG. 1 is a perspective view of an illustrative boat lift according to the present disclosure.

The drawings show various illustrative embodiments of a boat lift according to the present disclosure. As shown in FIG. 1, a boat lift according to the present disclosure includes a lifting mechanism 10 connectable to a structure S. Such a boat lift is configured to receive and support a hull of a boat, and it is operable to raise and lower the boat with respect to the structure S.

In an illustrative embodiment, as shown, for example, in FIG. 4, and as discussed further below, the structure S may be a space frame 110 configured to rest on the bottom B of a body of water W, for example, on the bed of a lake or stream.

In another illustrative embodiment, as shown, for example, in FIG. 8, and as discussed further below, the structure S may be a floating structure 210, for example, a structure connected to a floating dock FD.

In a further illustrative embodiment, as shown, for example, in FIG. 11, and as discussed further below, the structure S may be a permanent, fixed structure 310, for example, a wall defining a slip as might be found in a boat house.

The foregoing embodiments are merely illustrative. In other embodiments, a boat lift according to the present disclosure could include a lifting mechanism connected to other structures in other ways.

Lifting Mechanism

As shown, for example, in FIG. 1, the lifting mechanism 10 may include first through fourth linear actuators 12A-12D (sometimes referred to herein collectively or individually as linear actuators 12*n*), a first carrier 14A connected between the first and second linear actuators 12A, 12B, and a second carrier 14B connected between the third and fourth linear actuators 12C, 12D. Optional first and second hull supports 16A, 16B may be connected between the first carrier 14A and the second carrier 14B.

As suggested above, each of the linear actuators 12A-12D is connectable to a corresponding structure S in a generally vertical orientation. With the linear actuators 12A-12D connected to the corresponding structure(s) S, the actuators may be actuated to selectively raise and lower the first and second carriers 14A, 14B with respect to the structure.

Each of the linear actuators 12A-12D includes a corresponding housing 20A-20D and a corresponding actuator rod 22A-22D extendable from and retractable into the housing. Each housing 20A-20D may be directly or indirectly connected to the structure S. As shown in phantom in FIG. 2A, the free end of each actuator rod 22A-22D may be threaded to receive a mating nut, or it may be otherwise configured to receive another form of fastener to secure the respective actuator rod to the corresponding carrier 14A, 14B. In an embodiment, a universal joint, for example, a Heim joint or other form of ball joint or universal joint could be connected to the free end of the actuator rod 22A-22D and in turn connected to the respective carrier 14A, 14B in any suitable manner. In a further embodiment, a turnbuckle arrangement could interconnect the actuator rods 22A-22D to the carriers 14A, 14B.

The linear actuators 12A-12D may be connected between the carriers 14A, 14B and the structure(s) S so that extension of the actuator rods 22A-22D from the housings 20A-20D results in lowering of the carriers with respect to the structure(s) and retraction of the actuator rods into the housings results in raising of the carriers with respect to the structure(s). Alternatively, the linear actuators 12A-12D may be connected between the carriers 14A, 14B and the structure(s) S so that extension of the actuator rods 22A-22D from the housings 20A-20D results in raising of the carriers with respect to the structure(s) and retraction of the actuator rods into the housings results in lowering of the carriers with respect to the structure(s).

The linear actuators 12A-12D will be discussed in further detail below.

As mentioned above, the first carrier 14A is configured for connection to the actuator rods 22A, 22B of the first and second linear actuators 12A-12B, and the second carrier 14B is configured for connection to the actuator rods 22C, 22D of the third and fourth linear actuators 12C-12D. To this end, as shown in FIGS. 2A and 2B, each of the first carrier 14A and the second carrier 14B may define respective apertures therethrough for receiving the free ends of the respective actuator rods 22A-22D or other, intervening components.

Figure 2A:
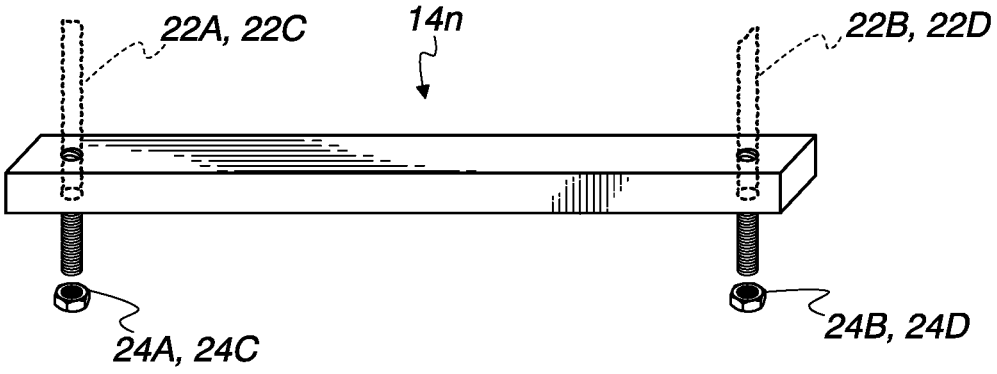
FIG. 2A is a perspective view of an illustrative carrier of the boat lift of FIG. 1.
Figure 2B:
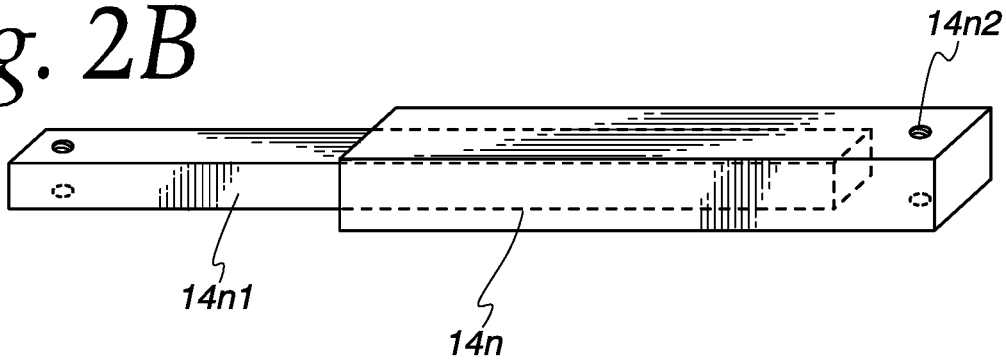
FIG. 2B is a perspective view of an alternative illustrative carrier of the boat lift of FIG. 1.

Each of the first carrier and the second carrier 14*n* may be a single structural member of fixed length, as shown in FIG. 2A. Alternatively, each of the first carrier and the second carrier 14*n* may be embodied as a telescopically adjustable carrier. For example, as shown in FIG. 2B, each of the first carrier and the second carrier 14*n* may be embodied as an assembly including an inner member 14*n*1 slidingly received within a corresponding outer member 14*n*2 and freely extendable and retractable with respect to the outer member.

Telescopically adjustable carriers 14A, 14B may enable a given lifting mechanism 10 to be connected to a variety of different structures S having differing distances between mounting locations for respective pairs of the linear actuators 12A-12D connected to the first and second carriers 14A, 14B. Also, telescopically adjustable carriers 14A, 14B may be useful in accommodating variations in the distance between respective pairs of the linear actuators 12A-12D connected to the first and second carriers 14A, 14B as might occur during use of the boat lift, for example, in a floating embodiment as discussed further below wherein respective pairs of the linear actuators 12A-12D connected to the first and second carriers 14A, 14B are not rigidly connected to each other.

As set forth above, the first and second hull supports 16A, 16B are optional. Where provided, the first and second hull supports 16A, 16B may cooperate to define a cradle 16 configured to receive a boat hull (not shown) may be connected between. The first and second hull supports 16A, 16B may be desirable, for example, in embodiments configured to support a boat (not shown) having a V-hull. In an embodiment, either or both of the first and second hull supports 16A, 16B could be embodied as first and second discontinuous sections, with the first section(s) thereof connected to the first carrier 14A and the second section(s) thereof connected to the second carrier 14B.

In an embodiment, the first and second hull supports 16A, 16B could be omitted and either or both of the first and second carriers 14A, 14B could be integrally configured as a cradle configured to support the hull of a boat (not shown) directly.

In another embodiment, for example, an embodiment configured to support a pontoon boat, the first and second hull supports 16A, 16B could be omitted, and the first and second carriers 14A, 14B could be configured to receive the pontoons directly.

Figure 3:
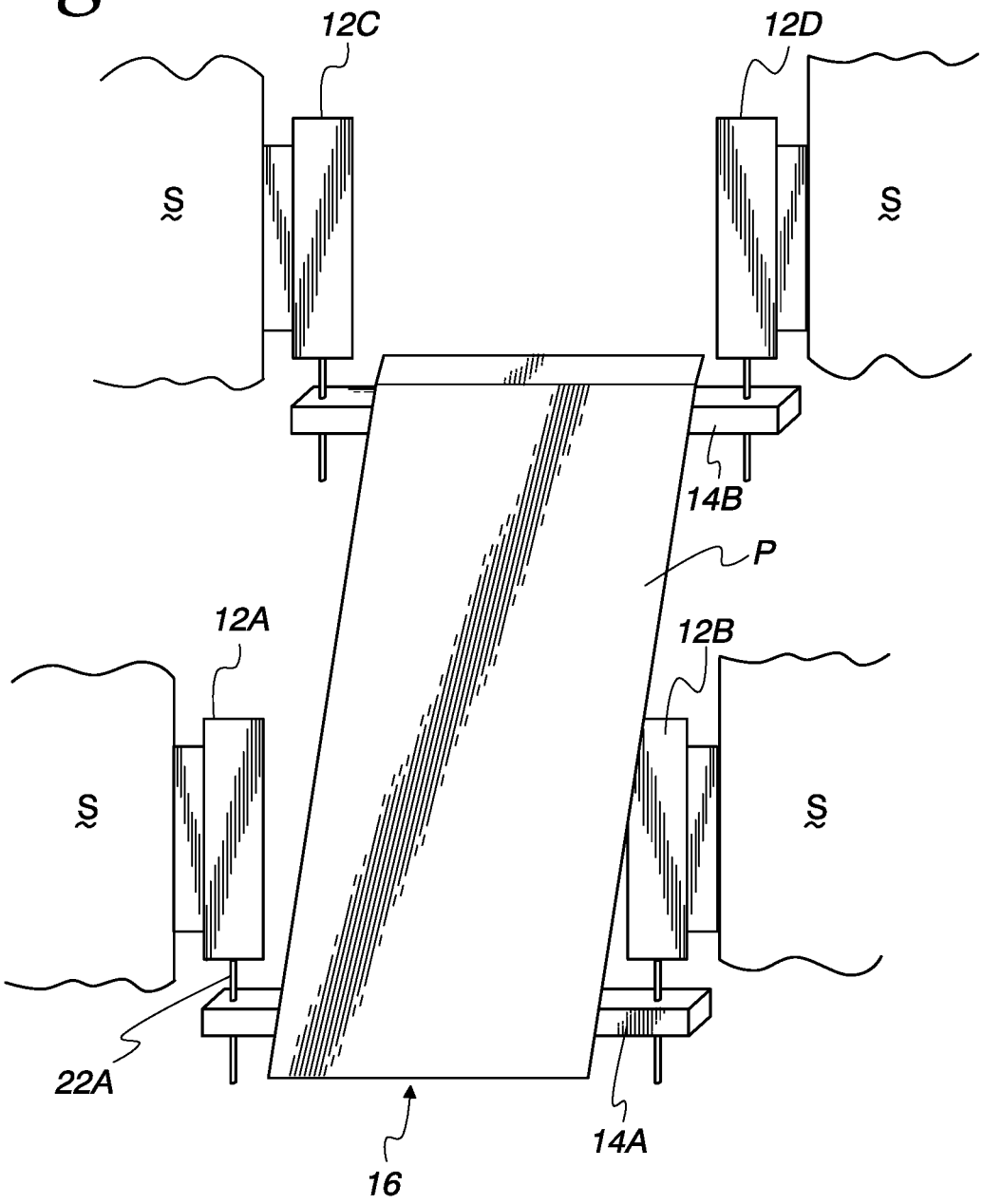
FIG. 3 is a perspective view of an alternative illustrative boat lift according to the present disclosure.

In an embodiment, as shown, for example, in FIG. 3, the first and second hull supports 16A, 16B may be omitted and a platform P may be connected between the first carrier 14A and the second carrier 14B. The platform P may be generally imperforate, or it may be perforated to facilitate lowering the platform into, or raising the platform from, a body of water. The platform P could include a load surface and a plurality of stiffeners (not shown) configured to inhibit flexing of the load surface. The stiffeners may depend from the load surface about its perimeter, extending from side-to-side thereof, end-to-end thereof or otherwise. The stiffeners could be embodied as boxed members or otherwise.

In such embodiments, the platform P could be used a support surface for chairs, loungers, grills and any variety of other leisure living accessories. The platform P could be configured to be co-extensive with or immediately adjacent a deck of a corresponding dock, boathouse floor, or other structure when the platform P is in a raised position. As such, the platform could effectively increase the footprint of the dock. Also, the platform P could be used to safely lower a person from a raised position wherein the platform is out of the water to a lowered position wherein the platform is submerged in the water.

Upper surfaces of the first and second carriers 14A, 14B, the first and second hull supports 16A, 16B, and/or the platform P could be made of or covered with rubber, fabric, or another material selected to preclude or inhibit damage to a hull of a boat or other object supported by such surfaces.

Free-Standing Support Structure

Figure 4:
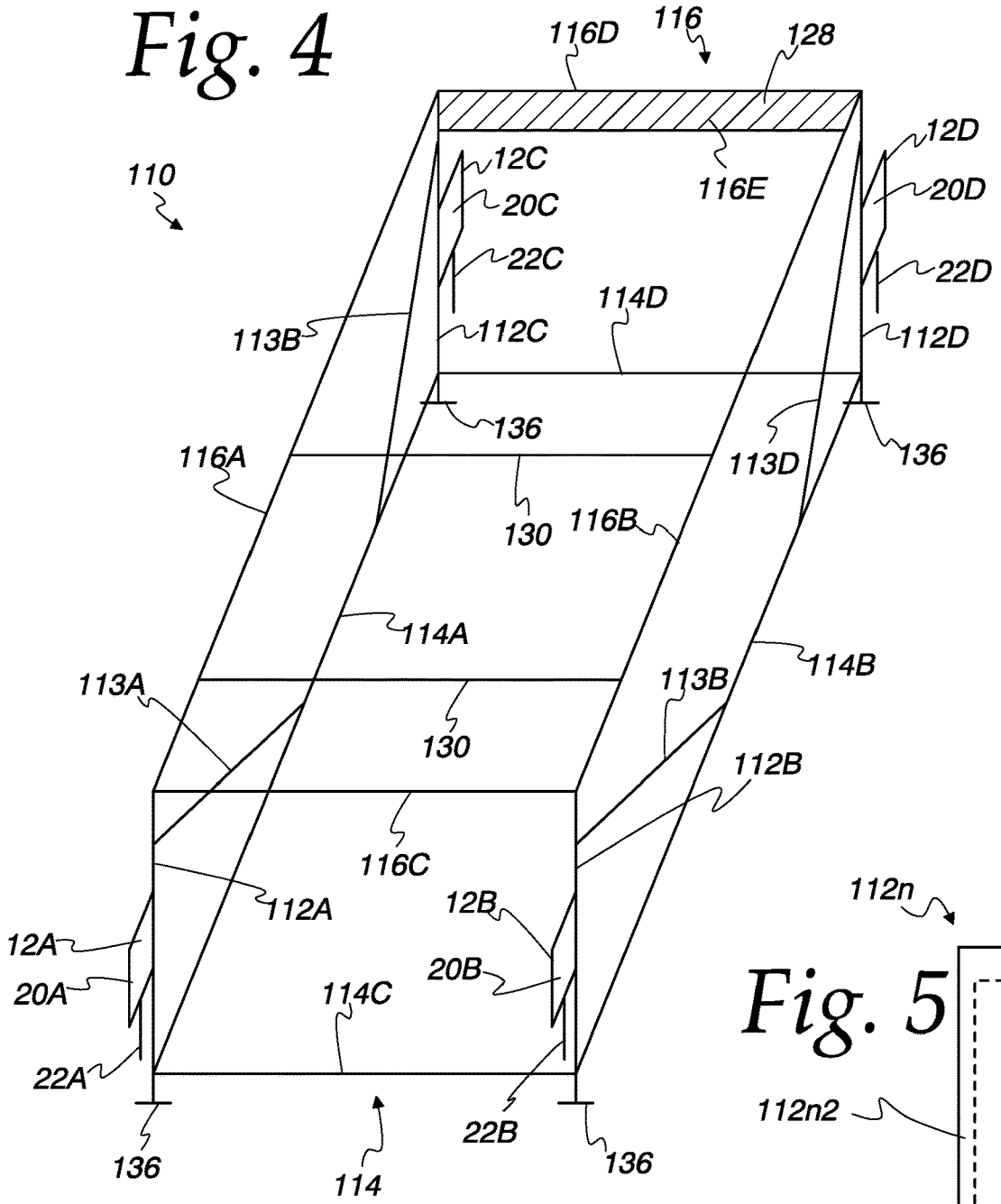
FIG. 4 is a perspective view of an illustrative free-standing or grounded boat lift according to the present disclosure.
Figure 5:
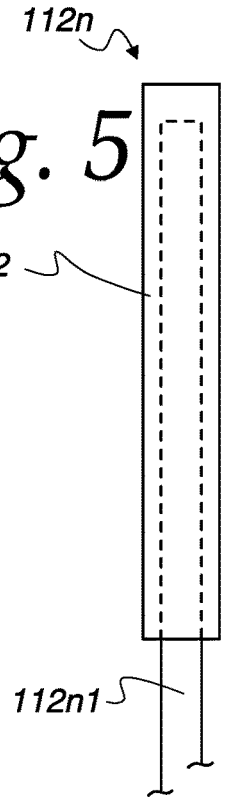
FIG. 5 is a side elevation view of a portion of a post of the boat lift of FIG. 4.
Figure 6:
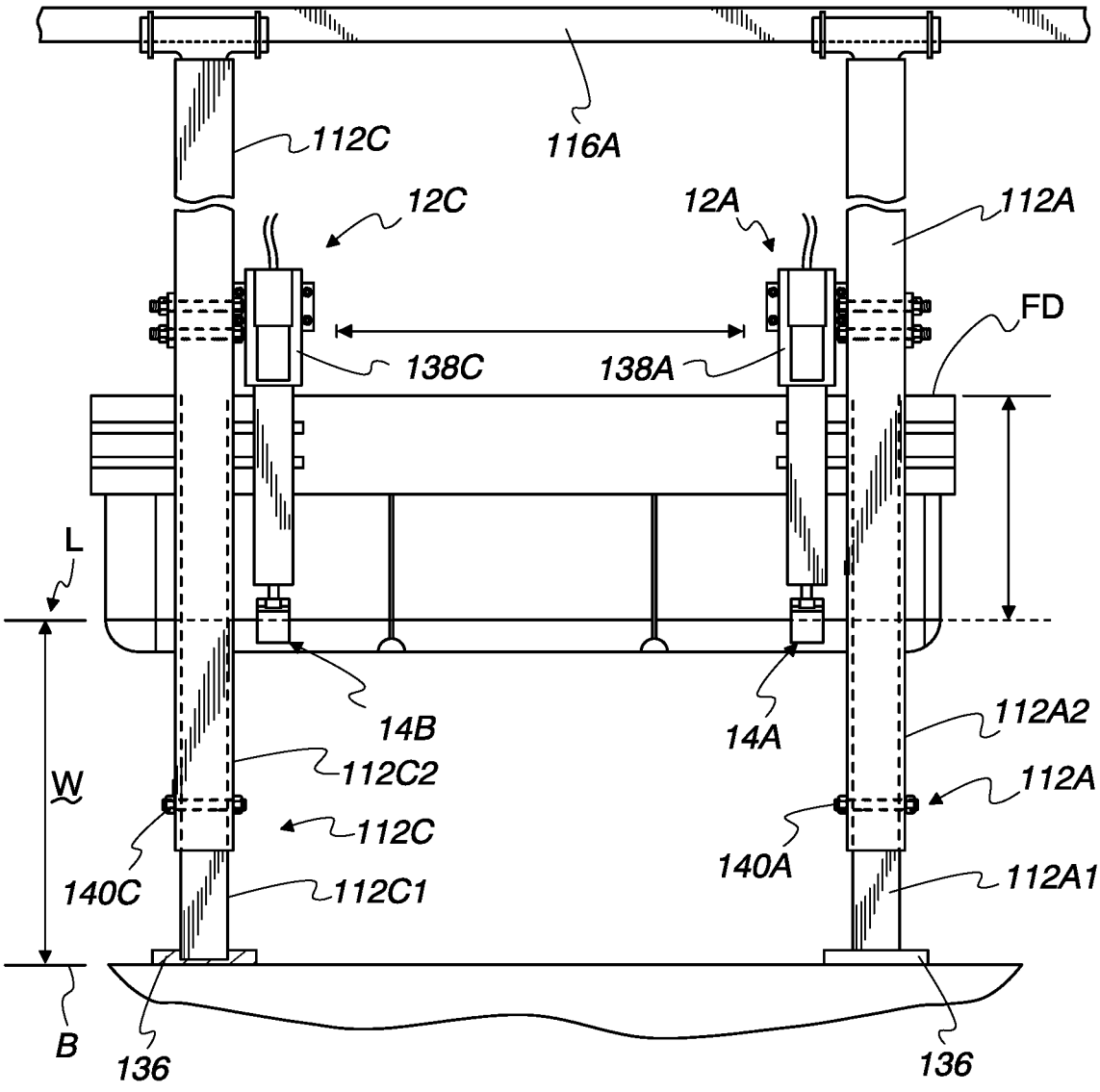
FIG. 6 is a side elevation view of the boat lift of FIG. 4 positioned on the bottom of a body of water.

As shown in FIGS. 4-6, the structure S to which the lifting mechanism 10 is connected may be a space frame 110 configured for placement on the bottom B of a body of water W, for example, a lake or river bed. The space frame 110 may be portable. For example, the space frame 110 may be readily removable from the body of water for winter storage or relocation to another site.

The space frame 110 includes four parallel posts 112A-112D (sometimes referred to herein collectively or individually as posts 112*n*) arranged to define a quadrilateral, for example, a square, rectangle, or other four-sided geometric shape. Each of the posts 112*n* is oriented vertically, thereby defining an upper (or first) end and a lower (or second) end. A foot pad 136 may be attached to or otherwise associated with the lower end of each post 112*n* to better distribute loads applied by the space frame 110 to the ground upon which the boat lift may rest.

A lower frame 114 interconnects the posts 112*n* at or near respective lower ends thereof. As shown, the lower frame 114 includes a first lower frame member 114A interconnecting the first post 112A and the third post 112C, a second lower frame member 114B interconnecting the second post 112B and the fourth post 112D, a third lower frame member 114C interconnecting the first post 112A and the second post 112B, and a fourth lower frame member 114D interconnecting the third post 112C and the fourth post 112D. The lower frame members 114*n* may be connected to the posts 112*n* directly or through intervening brackets or fittings.

A first diagonal brace 113A may connect an upper portion of the first post 112A to an intermediate portion of the first lower frame member 114A. A second diagonal brace 113B may connect an upper portion of the second post 112B to an intermediate portion of the second lower frame member 114B. A third diagonal brace 113C may connect an upper portion of the third post 112C to an intermediate portion of the first lower frame member 114A. A fourth diagonal brace 113D may connect an upper portion of the fourth post 12D to an intermediate portion of the second lower frame member 114B.

An upper frame 116 interconnects the posts 112*n* at or near respective upper ends thereof. As shown, the upper frame 116 includes a first upper frame member 116A connecting together the first post 112A and the third post 112C, and a second upper frame member 116B connecting together the second post 112B and the fourth post 112D. The upper frame 116 also includes a third upper frame member 116C connecting the first upper frame member 116A to the second upper frame member 116B near the first and second posts 112A, 112B, respectively, and a fourth upper frame member 116D connecting the first upper frame member 116A to the second upper frame member 116B near the third and fourth posts 112C, 112D, respectively. Alternatively, the third upper frame member 116C could connect together the first and second posts 112A, 112B, and the fourth upper frame member 116D could connect together the third and fourth posts 112C, 112D. The upper frame members 116*n* may be connected to the posts 112*n* and/or to each other directly or through intervening brackets or fittings.

In other embodiments, the lower frame 114 and the upper frame 116 could interconnect the posts 112*n* in any other suitable manner. For example, any or all of the foregoing frame members 114*n*, 116*n* could interconnect corresponding ones of the posts 112*n* diagonally.

The upper frame 116 could include further members connecting together the first and second upper frame members 116A, 116B. For example, the upper frame 116 could include a fifth upper frame member 116E connected between the first and second upper frame members 116A, 116B and that could cooperate with the third upper frame member 116C to define supports for a platform or deck 128 that could be used, for example, to support mechanical and electrical equipment associated with the space frame 110.

A plurality of canopy supports 130 may be provided in connection with the upper frame 116 as supports for a canopy (not shown). Each of the canopy supports 130 may be embodied as a bowed member having a first end connected to the first upper frame member 116A and a second end connected to the second upper frame member 116B.

Each of the posts 112*n* may be telescopically adjustable so that the length (or height) of the posts may be varied as desired. For example, as shown in FIG. 5, each post 112*n* may include an inner member 112*n*1 sliding received with an outer member 112*n*2. Each of the inner member 112*n*1 and the outer member 112*n*2 could define one or more apertures extending radially therethrough and alignable with similar, corresponding apertures defined by the other of the inner member and the outer member. A corresponding pin 140*n* could be inserted through the aligned apertures to fix the outer portion with respect to the inner portion, thereby fixing the length of the post 112*n* at a desired length. In such embodiments, the lower frame 114 and the upper frame 116 typically would be connected to the outer members 112*n*2 of the posts 112*n*.

Telescopic posts 112*n* may be beneficial, for example, to accommodate variations in the level of the bottom B of a body of water W in which the space frame 110 might be installed to help level the space frame with respect to the water line, or to better accommodate boats having differing drafts.

FIG. 4 shows optional foot pads 136 extending downwardly from respective ones of the posts 112*n*. The foot pads 136 are configured for placement upon the bottom B of a body of water, for example, a lake or river bed. In an embodiment, the foot pads 136 could be omitted and the bottom frame 114 could be configured for placement upon the bottom of the body of water. In such an embodiment, the lower ends of the posts 112*n* typically would not extend downwardly beyond the bottom of the bottom frame 114.

As shown in FIG. 4, the housing 20A of the first linear actuator 12A is connected to the first post 112A, the housing 20B of the second linear actuator 12B is connected to the second post 112B, the housing 20C of the third linear actuator 12C is connected to the third post 112C, and the housing 20D of the fourth linear actuator 12D is connected to the fourth post 112D. The housings 20*n* of the linear actuators 12*n* may be connected to the respective posts 112*n* directly or through intervening brackets or fittings.

The linear actuators 12*n* are shown in FIG. 4 as being installed to the posts 112*n* outside the space frame 110. Put another way, the linear actuators 12*n* are shown as not being located between adjacent posts 112*n*. In an embodiment, any or all of the linear actuators 12*n* could be installed between adjacent posts 112*n*. For example, the first linear actuator 12A could be installed between the first post 112A and the second post 112B, or between the first post 112A and the third post 112C, as shown in FIG. 6.

The linear actuators 12*n* may be connected to the respective posts 112*n* in a manner that allows a user to readily adjust the vertical position of the linear actuators with respect to the posts, for example, to accommodate variations in the level of the surface of a body of water in which the space frame 110 might be installed or to better accommodate different boats having different geometries. For example, as shown in FIG. 6, the linear actuators 12*n* could be clamped or strapped to the respective posts 112*n*.

In an embodiment, the first and/or third linear actuators 12A, 12C could instead be connected to a cross member (not shown) connecting the first and third posts 112A, 112C. Similarly, the second and/or fourth linear actuators 12B, 12D could instead be connected to a cross member (not shown) connecting the second and fourth posts 112B, 112D. In a further embodiment, the third and/or fourth linear actuators 12C, 12D could instead be connected to a cross member (not shown) connecting the third and fourth posts 112C, 112D. In such embodiments, the linear actuators 12*n* may be connected to the corresponding cross members near a respective post 112*n*.

The first through fourth posts 112A-112D and the respective first through fourth linear actuators 12A-22D may be spaced apart from each other by any desired distance(s) so that the space frame 110 may accommodate a boat of any desired size. For example, respective pairs of the posts 112A-112D and actuators 12A-12D may be spaced apart from each other by as little as ten feet or less and as much as twenty feet or more or by any intermediate distance.

Figure 7:
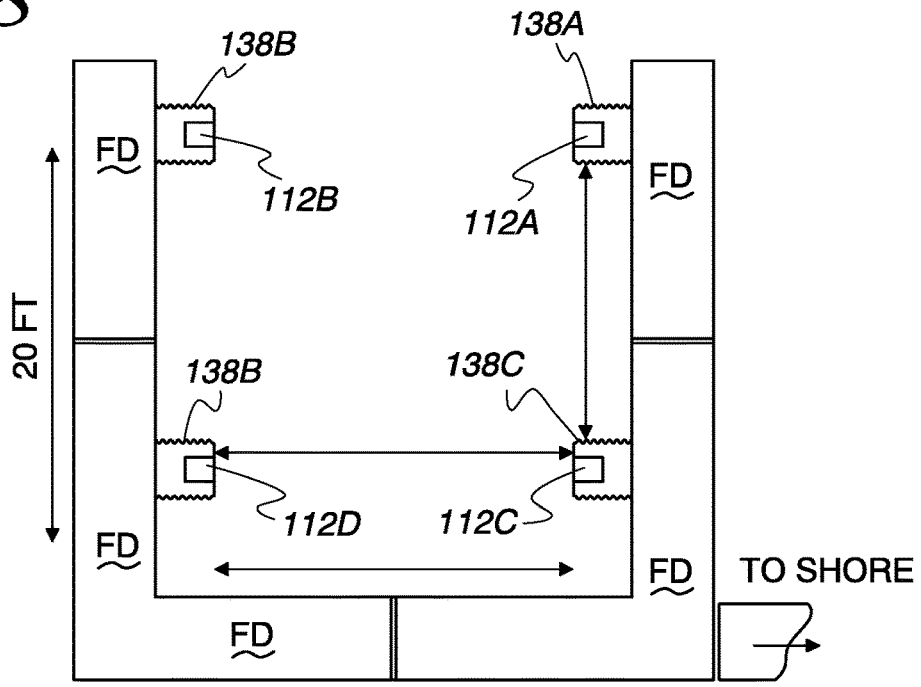
FIG. 7 is a top plan view of the boat lift of FIG. 4 with certain features omitted for clarity.

In an embodiment, as shown in FIGS. 6 and 7, a floating dock FD may be associated with the space frame 110. The floating dock FD may include one or more pontoons or float units and a deck or platform disposed thereon. As shown in FIG. 7 (showing only the posts 112*n* of the space frame 110 and the floating dock FD), a sleeve 138*n* may be connected to either or both of the pontoon(s) and the deck of the floating dock FD at locations corresponding to the locations of the posts 112*n*. Each sleeve 138*n* may receive a corresponding one of the posts 112*n* in sliding engagement therewith to allow the floating dock FD to rise and fall with respect to the post in response to variations in water surface level L. In such an embodiment, the floating dock FD could be attached to the left side, rear, and/or right side of the space frame 110. The front of the space frame 110 typically would be left unobstructed to allow for ingress and egress of a boat to and from the space frame and the lifting mechanism supported thereby.

The lifting mechanism 10 can be provided with a space frame, for example, a space frame 110 as discussed above. Alternatively, the lifting mechanism 10 can be retrofitted to a space frame of an existing boat lift.

A buoyant object, for example, an inner tube, sufficient to buoy the space frame 110 and the attached lifting mechanism 10 could be temporarily secured to the first and second carriers 14A, 14B (or the hull supports 16A, 16B or platform P connected thereto). The linear actuators 12*n* could then be actuated to drive the buoyant object down into a body of water in which the space frame may be located, thereby enabling a user to float the space frame 110 and attached lifting mechanism 10 between different locations. Once the space frame 110 and attached lifting mechanism 10 have been floated to the desired location, the linear actuators 12*n* could be actuated to raise the buoyant object out of the body of water, and the buoyant object could be removed from the carriers 14*n* or other component attached thereto.

Floating Support Structure

Figure 8:
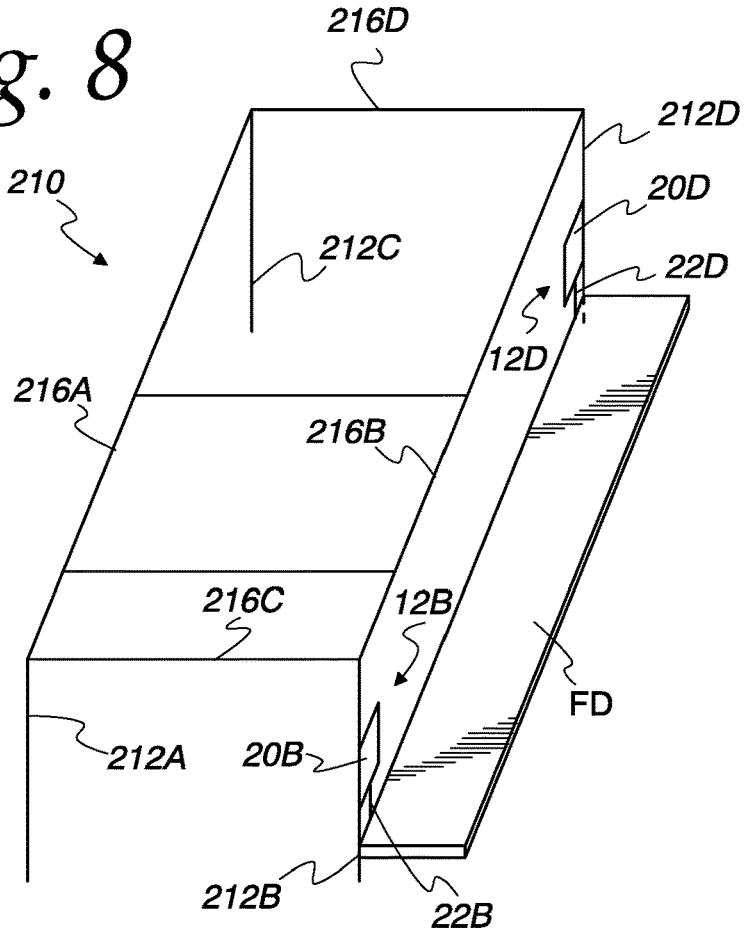
FIG. 8 is a perspective view of an illustrative floating boat lift according to the present disclosure with numerous features omitted for clarity.
Figure 9:
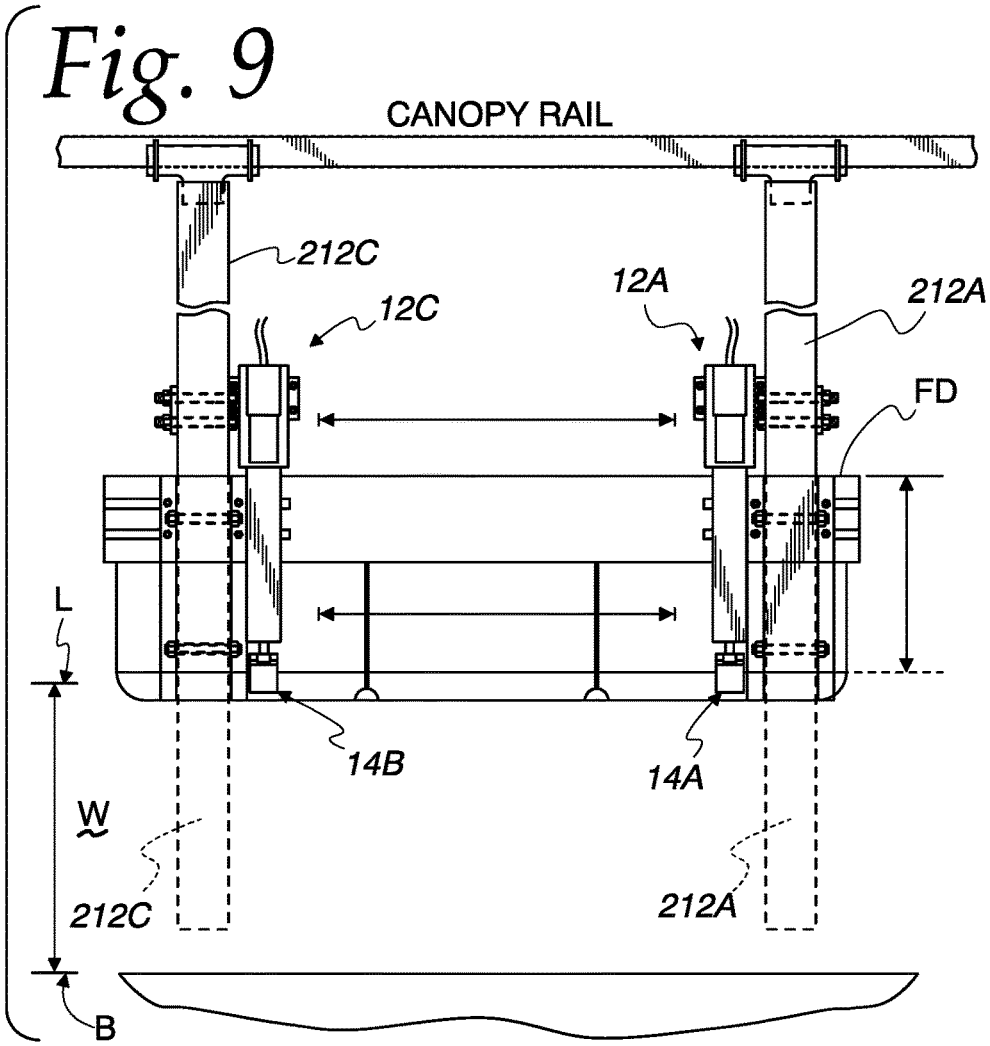
FIG. 9 is a side elevation view of the boat lift of FIG. 8.
Figure 10:
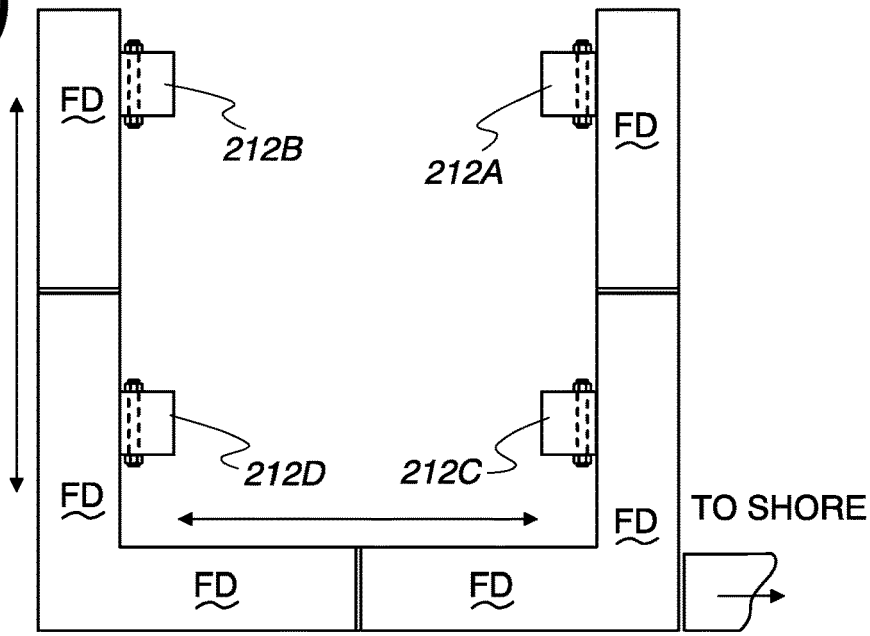
FIG. 10 is a top plan view of the boat lift of FIG. 8.

In another embodiment, as shown in FIGS. 8-10, the structure S may be a space frame 210 or portion thereof secured to a floating dock FD or other floating structure. Such an embodiment may include four posts 212A-212D securely connected to corresponding floating dock sections FD and an upper frame 216 connecting together upper portions, for example, upper ends, of the four posts. The four posts 212A-212D may be similar to the four posts 112A-112D, and the upper frame 216 may be similar to the upper frame 116 discussed above.

Alternatively, such an embodiment may include four posts 212A-212D connected to corresponding floating dock sections FD and a lower frame (not shown, but similar to the lower frame 114) connecting together lower portions, for example, lower ends, of the four posts. The four posts 212A-212D may be similar to the four posts 112A-112D discussed above. In such an embodiment, the upper frame 216 could be omitted and the posts 212*n* need be no taller than necessary to support the linear actuators 12*n*.

A further alternative embodiment may include four posts 212A-212D connected to corresponding floating dock sections FD, an upper frame 216 connecting together upper portions, for example, upper ends, of the four posts, and a lower frame 214 connecting together lower portions, for example, lower ends, of the four posts.

In any of the foregoing floating embodiments, the linear actuators 12A-12D may be connected to the respective posts 212A-212D in a manner similar to that in which the linear actuators may be connected to the posts 112A-112D, as discussed above. Alternatively, the linear actuators 12A-12D may be connected to cross members (not shown) connecting together the posts 212A-212D in a manner analogous to that discussed above in connection with the space frame 110.

In any of the foregoing embodiments, the lower ends of the posts 212*n* may terminate well above the bottom LB of a body of water W in which the space frame 210 and floating dock FD is disposed so that the space frame 210 is floatingly supported by the floating dock FD. In alternative embodiments, any or all of the posts 212*n* (or one or more additional posts (not shown) extending downwardly from the floating structure 210, FD) may be configured so that the space frame 210 is floatingly supported by the floating dock FD when unloaded and so that the lower ends of the any or all of the posts 212*n* may contact and be supported by the bottom LB when the space frame is carrying the weight of a boat supported thereby.

Fixed Support Structure

Figure 11:
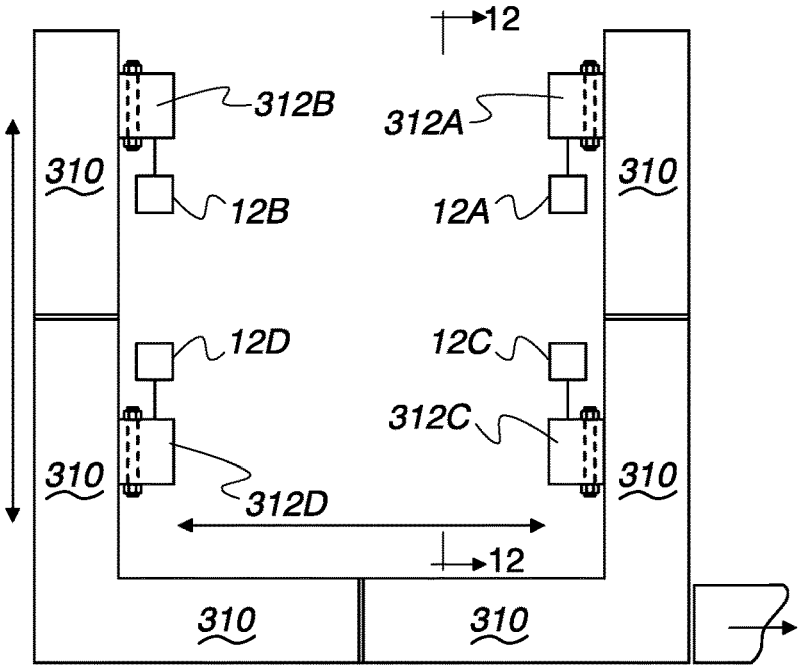
FIG. 11 is a top plan view of an illustrative permanently mounted boat lift according to the present disclosure with numerous features omitted for clarity.
Figure 12:
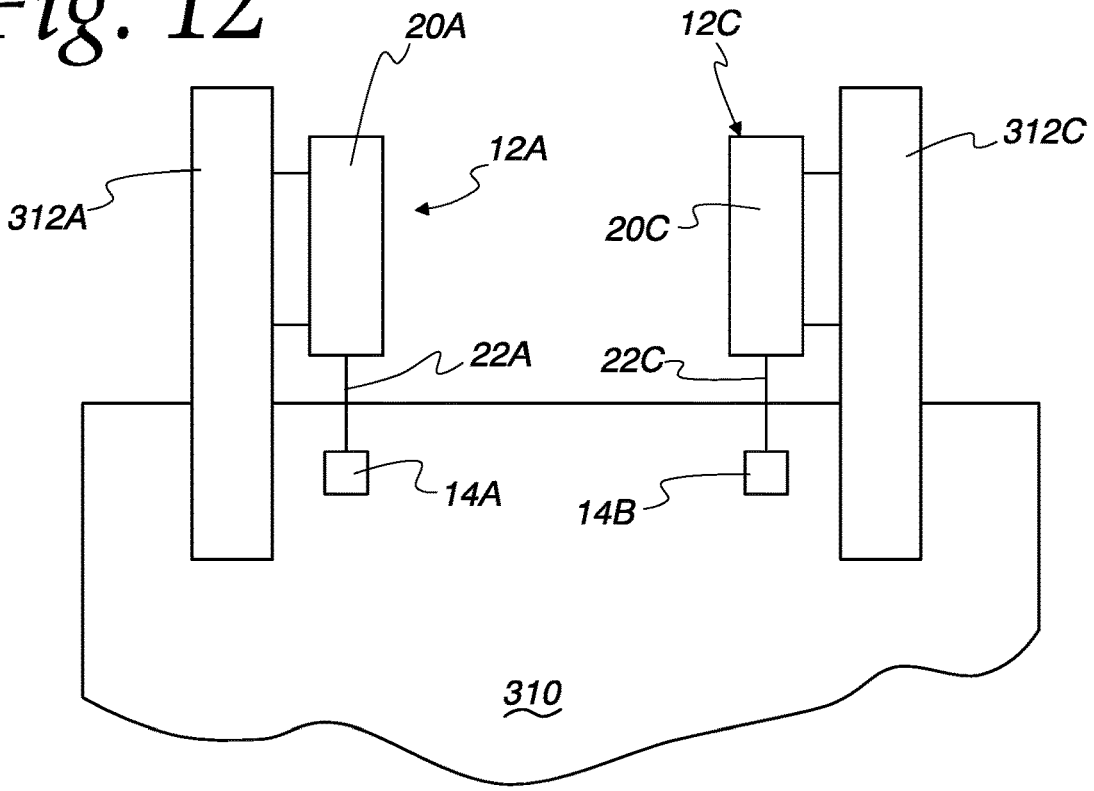
FIG. 12 is a side cross-sectional view of the boat lift of FIG. 11.

As shown in FIGS. 11-12, the structure S may be a pier or a wall 310 of a boat house or other fixed structure. Posts 312A-312D may be connected to the wall 310 at desired locations directly or through suitable intervening brackets. The brackets could be L-shaped, having a surface abutting a side surface of the wall and an upper surface of the wall. The connection could be made using any suitable hardware, for example, concrete expansion anchors, lag screws, nuts and bolts, or the like extending through and securing the posts 312A-312D and/or intervening brackets to the side and or upper surfaces of the wall 310.

The posts 312*n* could be similar to the posts 212*n*, and they could support an upper frame (not shown) similar to the upper frame 116. Such an embodiment might be desirable wherein the structure S is a pier or another structure located outdoors or where an upper frame is desired.

In an embodiment wherein an upper frame is not desired, for example, an indoor embodiment wherein the structure S is a wall 310 of a boat house, the posts 312*n* need be no taller than necessary to support the linear actuators 12*n*.

In any of the foregoing floating embodiments, the linear actuators 12A-12D may be connected to the respective posts 312A-312D in a manner similar to that in which the linear actuators may be connected to the posts 112A-112D, as discussed above.

Linear Actuators and Hydraulic System

Each of the first through fourth linear actuators 12A-12D may be a hydraulic actuator having a cylinder (analogous to the actuator housing 20*n*), a piston slidably received within the cylinder, and a piston rod (analogous to the actuator rod 22*n*) connected to a rod side of the piston, the piston rod having a free end and the piston rod extendable from and retractable into the cylinder in response to the piston sliding within the cylinder. The cylinder and the non-rod side of the piston define a first (or extend) pressure chamber, and the cylinder and a rod side of the piston define a second (or retract) pressure chamber.

Each of the first and second pressure chambers is hydraulically coupled through corresponding hydraulic conduits to a hydraulic circuit including a hydraulic pump and a hydraulic fluid reservoir. An electric motor may be provided to drive the pump. The hydraulic circuit may also include one or more control valves or manifolds electively configurable to isolate one or both of the first and second pressure chambers, to direct pressurized hydraulic fluid from the pump to one or the other of the first and second pressure chambers, and/or to allow hydraulic fluid to be relieved from one or the other of the first and second pressure chambers to the fluid reservoir. In an embodiment, the entirety of the hydraulic circuit may at all times be above the water line when the lifting mechanism 10 is in use or otherwise installed in a body of water.

The piston may be slidingly moved within the cylinder, and the piston rod correspondingly extended from or retracted into the cylinder in response to adding hydraulic fluid to, and thereby pressurizing, one of the first and second pressure chambers, while simultaneously relieving hydraulic fluid from, and thereby depressurizing the other of the first and second pressure chambers. For example, the piston rod may be extended from the cylinder by providing pressurized hydraulic fluid to the first pressure chamber, for example, from the pump, while simultaneously relieving hydraulic fluid from the second pressure chamber, for example, to the reservoir. Similarly, the piston rod may be retracted into the cylinder by providing pressurized hydraulic fluid to the second pressure chamber, for example, from the pump, while simultaneously relieving hydraulic fluid from the first pressure chamber, for example, to the reservoir.

In an embodiment, the pump may be a bi-directional pump driven by a bi-directional motor, the pump having a first high-pressure output hydraulically coupled to the first pressure chamber, and a second high pressure output hydraulically coupled to the second pressure chamber. Operation of the motor and pump in a first direction directs high pressure fluid to the first pressure chamber, and operation of the motor and pump in a second direction directs high pressure fluid to the second pressure chamber.

In another embodiment, the pump may be a uni-directional pump configured to provide pressurized fluid to a high-pressure output. The high-pressure output may be connected to a control valve or manifold that selectively hydraulically couples the high-pressure output to the first or second pressure chamber.

Figure 13:
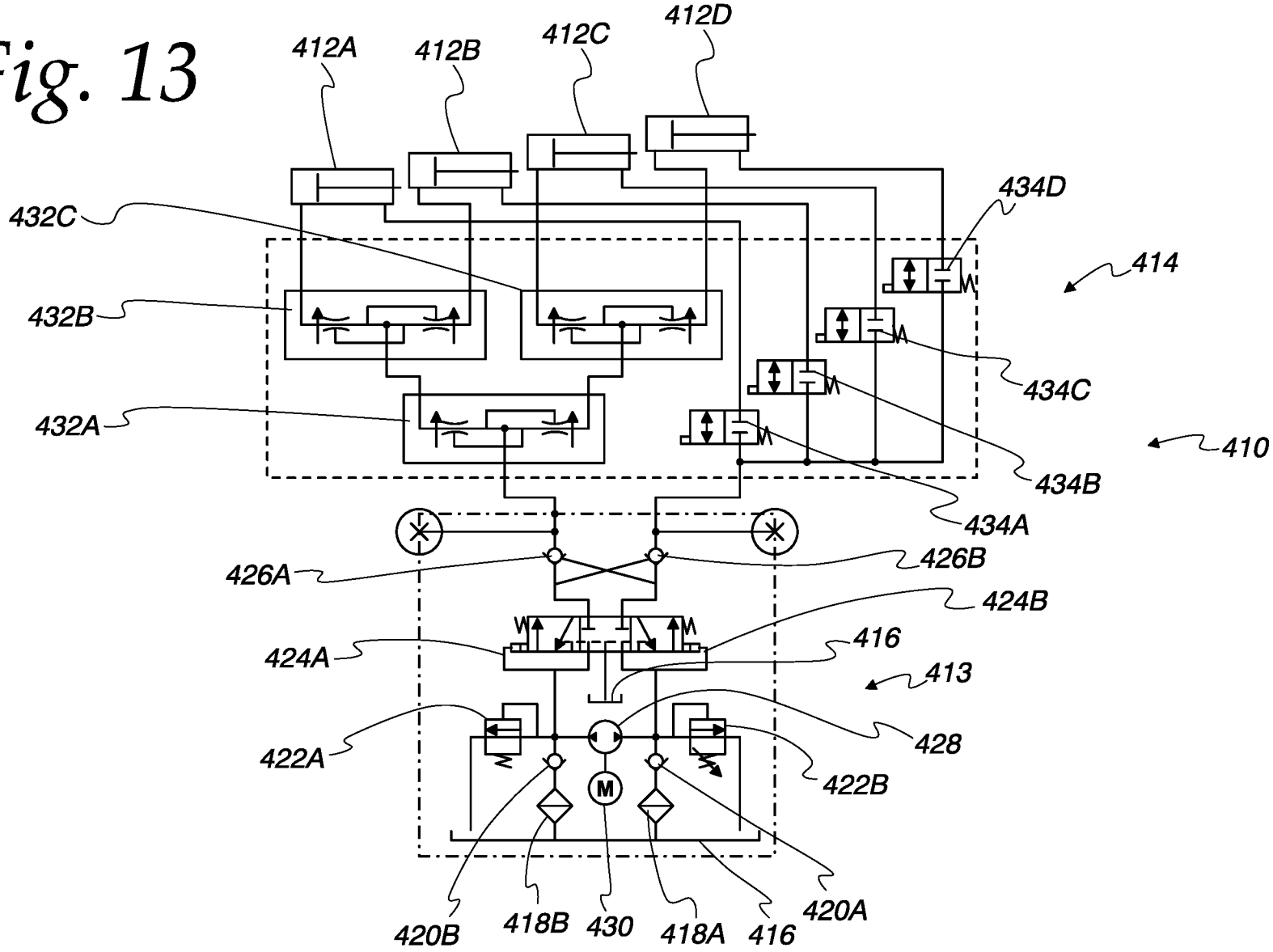
FIG. 13 is a schematic diagram of an illustrative hydraulic circuit according to the present disclosure.

In an embodiment, the first through fourth linear actuators 12A-12D may be hydraulic actuators 412A-412D operated using the hydraulic system 400 shown in FIG. 13. The hydraulic system 410 includes a hydraulic power section 413 and a flow divider and blocking section 414.

The hydraulic power section 413 includes a fluid reservoir 416, first and second filters/strainers 418A, 418B in fluid communication with the reservoir, first and second check valves 420A, 420B in fluid communication, respectively, with the first and second filters/strainers, a pump 428 in fluid communication with the first and second check valves, first and second pressure relief valves 422A, 422B in fluid communication with the pump and the reservoir, first and second flow control and block valves 424A, 424B in fluid communication with the pump, and first and second pilot operated check valves 426A, 426B in fluid communication with the flow control and block valves. A bi-directional electric motor 430 is configured to selectively drive the pump 428.

The flow divider and blocking section 414 includes a first flow divider valve 432A having an input in fluid communication with the first pilot operated check valve 426A, a second flow divider valve 432B having an input in fluid communication with a first output of the first flow divider valve 432A, and a third flow divider valve 432C having an input in fluid communication with a second output of the first flow divider valve 432A. The second flow divider valve 432B also has a first output in fluid communication with the extend chamber of the first hydraulic actuator 412A and a second output in fluid communication with the extend chamber of the second hydraulic actuator 412B. The third flow divider valve 432C also has a first output in fluid communication with the extend chamber of the third hydraulic actuator 412C and a second output in fluid communication with the extend chamber of the fourth hydraulic actuator 412D. In the embodiment shown, the flow divider valves 432A-432C are spool-type flow divider valves. In other embodiments, the flow divider valves 432A-432C could take other forms, for example, gear-type flow dividers or synchronized cylinder flow dividers.

The flow divider and blocking section 414 also includes a first blocking valve 434A having a first port in fluid communication with the retract chamber of the first hydraulic actuator 412A, a second blocking valve 434B having a first port in fluid communication with the retract chamber of the second hydraulic actuator 412B, a third blocking valve 434C having a first port in fluid communication with the retract chamber of the third hydraulic actuator 412C, and a fourth blocking valve 434D having a first port in fluid communication with the retract chamber of the fourth hydraulic actuator 412D. Each of the first through fourth blocking valves 434A-434D has a second port in fluid communication with the second port of the others of the first through fourth blocking valves and with the second pilot operated relief valve 426B. Each of the first through fourth blocking valves 434A-434D includes a solenoid operator configured to place the respective blocking valve into a flow state permitting fluid flow between the first and second ports thereof and a blocking state prohibiting fluid flow between the first and second ports thereof.

In use, the motor 430 may be operated in a first direction or a second direction, in turn, driving the pump 428 in a corresponding first direction or second direction. With the motor 430 running in either direction, the solenoid operators associated with the first through fourth blocking valves 434A-434D may place the blocking valves in the flow state. Conversely, with the motor 430 not running, the solenoid operators associated with the first through fourth blocking valves 434A-434D may place the blocking valves in the blocking state.

With the pump 428 operating in the first direction, the pump draws hydraulic fluid from the reservoir 416, through the first filter/strainer 418A and the first check valve 420A, and discharges pressurized hydraulic fluid through a corresponding hydraulic line to the first control valve 424A. If the fluid pressure between the output of the pump 428 and the first flow control valve 424A exceeds a threshold, the first pressure relief valve 422A may open to relieve hydraulic fluid to the reservoir 416.

With the pump 428 operating in the first direction and the first flow control valve 424A positioned to align the output of the pump with the first pilot operated check valve 426A, the pressurized hydraulic fluid is directed to the input of the first flow divider valve 432A. The first flow divider valve 432A may direct the pressurized fluid therethrough to either or both of the first and second outputs thereof. Pressurized fluid exiting the first flow divider valve 432A through the first output thereof is directed to the input of the second flow divider valve 432B. Pressurized fluid exiting the first flow divider valve 432A through the second output thereof is directed to the input of the third flow divider valve 432C.

The second flow divider valve 432B may direct the pressurized fluid therethrough to either or both of the first and second outputs thereof. Pressurized fluid exiting the second flow divider valve 432B through the first output thereof is directed to the extend chamber of the first hydraulic actuator 412A. Pressurized fluid exiting the second flow divider valve 432B through the second output thereof is directed to the extend chamber of the second hydraulic actuator 412B.

The third flow divider valve 432C may direct the pressurized fluid therethrough to either or both of the first and second outputs thereof. Pressurized fluid exiting the third flow divider valve 432C through the first output thereof is directed to the extend chamber of the third hydraulic actuator 412C. Pressurized fluid exiting the third flow divider valve 432C through the second output thereof is directed to the extend chamber of the fourth hydraulic actuator 412D.

Pressurized fluid entering the respective extend chamber of the first through fourth hydraulic actuators 412A-412D causes the piston to be displaced in the direction of the respective retract chamber, thereby forcing hydraulic fluid out of the retract chamber, through the respective blocking valve 434A-434D, and through the flow control valve 424, to the reservoir 416.

With the pump 428 operating in the second direction, the pump draws hydraulic fluid from the reservoir 416, through the second filter/strainer 418B and the second check valve 420B, and discharges pressurized hydraulic fluid through a corresponding hydraulic line to the control valve 424. If the fluid pressure between the output of the pump 428 and the flow control valve 424 exceeds a threshold, the second pressure relief valve 422B may open to relieve hydraulic fluid to the reservoir 416.

With the pump 428 operating in the second direction and the flow control valve 424 positioned to align the output of the pump with the second pilot operated check valve 426B, the pressurized hydraulic fluid is directed to the first through fourth blocking valves 434A-434D and to the retract chambers of the first through fourth actuators 412A-412D. The pressurized fluid entering the respective retract chamber of the first through fourth hydraulic actuators 412A-412D causes the piston to be displaced in the direction of the respective extend chamber, thereby forcing hydraulic fluid out of the extend chamber, through the flow divider valves 432A-432C, and through the flow control valve 424, to the reservoir 416.

The flow divider valves 432A-432C function to substantially equalize flow through the respective outputs thereof with the pump 428 running in either the first and second directions. The flow divider valves 432A-432C thereby function to substantially equalize the rates of extension and retraction of the piston rods from and into the cylinders of the respective hydraulic actuators 412A-412D. This feature enables the lifting mechanism 10 to maintain substantially constant the orientation of boat lifted thereby with respect to a datum, for example, the space frame 110, the water line S, or the bottom of the body of water underneath the boat lift.

With the pump 428 and/or the motor 430 running in either direction, the blocking valves 434A-434D are in the flow state. With the pump 428 and/or the motor 430 not running, the blocking valves 434A-434D are in the blocking state. With the blocking valves 434A-434D in the blocking state, the blocking valves preclude transfer of hydraulic fluid between the respective retract chambers of the actuators 412A-412D, thereby precluding displacement of the pistons and piston rods of the actuators when the pump and/or the motor are not running.

In another embodiment, each linear actuator 12*n* may be a self-contained electrohydraulic actuator (EHA) including a cylinder and a piston similar to the cylinder and piston of the foregoing hydraulic actuators 412A-412D and further including an integral hydraulic circuit and electric motor, as discussed further above. In such an embodiment, the electric motors of the several actuators may be operated individually or collectively, one-at-a-time or simultaneously. Individual control circuits or a common control circuit may be provided to operate ones of or all of the motors.

In a further embodiment, any two or more of the linear actuators 12*n* may be components of a common hydraulic circuit, as discussed further above, including a common hydraulic pump driven by an electric motor and a common hydraulic reservoir. Such an embodiment would also include a plurality of hydraulic lines interconnecting ones of the linear actuators 12*n* with the common hydraulic pump and the common hydraulic reservoir.

In other embodiments, any or all of the linear actuators 12*n* may be other forms of linear actuators, for example, Acme screw, ball screw, or water-driven actuators.

Auxiliary Components

A central control panel may be provided for operating the actuators 12*n*. In embodiments using EHAs, the actuators could be controlled individually or collectively. The control panel could be installable and removable using a connector so that the control panel could be removed when not in use to deter unauthorized use of the boat lift.

A battery could be provided to power the motor(s). The battery could be installed on the boat lift, for example, on a deck supported by an upper frame supported by the upper frame 116, 216. The battery could be removed and relocated for charging. A quick connector could be provided between the battery and corresponding wiring on the boat lift to facilitate battery removal and reinstallation.

In an embodiment, the boat lift could be powered by a battery installed on a boat on or adjacent the boat lift. A suitable wiring harness and connector could be provided to facilitate such use.

A solar panel could be provided for charging the boat lift battery. The solar panel also could be used to charge the boat battery. The solar panel could be mounted to one or more of the posts 12*n*, to a platform supported by the upper frame 16, or elsewhere.

Certain illustrative embodiments are shown and described herein. Features disclosed in connection with a given embodiment may be implemented in any other embodiment to the greatest extent possible. The drawings and description are not to be construed as limiting the scope of the invention as defined in the appended claims.

The invention claimed is:

1. A boat lift comprising a lifting mechanism and four support posts, each of the four posts having an upper end and a lower end, the lifting mechanism comprising:

a first linear actuator connected to the first post, the first linear actuator having a first actuator cylinder and a first actuator rod substantially parallel to the first post, the first actuator rod extendable from the first actuator cylinder and retractable into the first actuator cylinder;

a second linear actuator connected to the second post, the second linear actuator having a second actuator cylinder and a second actuator rod substantially parallel to the second post, the second actuator rod extendable from the second actuator cylinder and retractable into the second actuator cylinder;

a third linear actuator connected to the third post, the third linear actuator having a third actuator cylinder and a third actuator rod substantially parallel to the third post, the third actuator rod extendable from the third actuator cylinder and retractable into the third actuator cylinder;

a fourth linear actuator connected to fourth post, the fourth linear actuator having a fourth actuator cylinder and a fourth actuator rod substantially parallel to the fourth post, the fourth actuator rod extendable from the fourth actuator cylinder and retractable into the fourth actuator cylinder;

a first carrier connected to the first actuator rod and to the second actuator rod; and a second carrier connected to the third actuator rod and to the fourth actuator rod;

wherein the first and second linear actuators are configured to selectively move the first carrier between a first position relatively near the upper ends of the first and second posts by retracting the first and second actuator rods and a second position relatively near the lower ends of the first and second posts by extending the first and second actuator rods; and wherein the third and fourth linear actuators are configured to selectively move the second carrier between a first position relatively near the upper ends of the third and fourth posts by retracting the third and fourth actuator rods and a second position relatively near the lower ends of the third and fourth posts by extending the third and fourth actuator rods.

2. The boat lift of claim 1 further comprising:

a first upper frame member interconnecting the first post and the third post proximate the upper ends thereof;

a second upper frame member interconnecting the second post and the fourth post proximate the upper ends thereof;

a third upper frame member interconnecting the first post and the second post proximate the upper ends thereof; and a fourth upper frame member interconnecting the third post and the fourth post proximate the upper ends thereof.

3. The boat lift of claim 2, each of the first through fourth posts connected to a floating structure.

4. The boat lift of claim 3, the floating structure comprising a floating dock structure.

5. The boat lift of claim 2 further comprising:

a first lower frame member interconnecting the first post and the third post proximate the lower ends thereof;

a second lower frame member interconnecting the second post and the fourth post proximate the lower ends thereof;

a third lower frame member interconnecting the first post and the second post proximate the lower ends thereof; and a fourth lower frame member interconnecting the third post and the fourth post proximate the lower ends thereof.

6. The boat lift of claim 5 further comprising a first foot connected to the lower end of the first post.

7. The boat lift of claim 1, at least one of the first through fourth posts being telescopically extendable and retractable.

8. The boat lift of claim 1, at least one of the first and second carriers being telescopically extendable and retractable.

9. The boat lift of claim 1 further comprising a first hull support connected to at least one of the first carrier and the second carrier, and a second hull support connected to at least one of the first carrier and the second carrier.

10. The boat lift of claim 1 further comprising a platform connected between the first carrier and the second carrier configured to directly receive pontoons of a pontoon boat.

11. The boat lift of claim 1 further comprising a control system configured to simultaneously operate the first through fourth linear actuators to thereby cause the first through fourth actuator rods to simultaneously extend from or retract into the respective actuator cylinders.

12. The boat lift of claim 1 wherein the first through fourth linear actuators are first through fourth electrohydraulic actuators.

13. The boat lift of claim 1 wherein the first through fourth linear actuators are first through fourth hydraulic actuators.

14. The boat lift of claim 13 further comprising a hydraulic system hydraulically connected to the first through fourth hydraulic actuators and configured to selectively actuate the first through fourth hydraulic actuators, the hydraulic system comprising a hydraulic pump, a hydraulic circuit configured to communicate hydraulic fluid among the hydraulic pump and the first through fourth hydraulic actuators, and at least one hydraulic valve configured to control flow of the hydraulic fluid through the hydraulic circuit.

15. The boat lift of claim 13, the at least one hydraulic valve comprising a plurality of flow divider valves configured to substantially equalize rates of extension and retraction of the first through fourth hydraulic actuators.

16. The boat lift of claim 1 installed in a body of water with each of the first through fourth linear actuators above the water line both when the first and second carriers are in the respective first positions and when the first and second carriers are in the respective second positions.

* * * * *